US011499387B2

(12) United States Patent
Levert, Jr. et al.

(10) Patent No.: US 11,499,387 B2
(45) Date of Patent: Nov. 15, 2022

(54) HANGER RUNNING TOOL AND HANGER

(71) Applicant: Cameron International Corporation, Houston, TX (US)

(72) Inventors: Michael Levert, Jr., Katy, TX (US); Kyle Sommerfeld, Houston, TX (US); Gavin Robottom, Leeds (GB)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 23 days.

(21) Appl. No.: 16/908,614

(22) Filed: Jun. 22, 2020

(65) Prior Publication Data

US 2020/0392806 A1 Dec. 17, 2020

Related U.S. Application Data

(63) Continuation of application No. 15/455,089, filed on Mar. 9, 2017, now Pat. No. 10,689,935.

(51) Int. Cl.
*E21B 33/04* (2006.01)
*E21B 23/02* (2006.01)

(52) U.S. Cl.
CPC ..... *E21B 33/04* (2013.01); *E21B 23/02* (2013.01)

(58) Field of Classification Search
CPC ..... E21B 33/04; E21B 23/02
USPC ..... 166/75.14
See application file for complete search history.

(56) References Cited

U.S. PATENT DOCUMENTS

| | | | | |
|---|---|---|---|---|
| 4,836,288 | A | 6/1989 | Wester | |
| 4,900,041 | A * | 2/1990 | Hopkins | E21B 33/04 277/328 |
| 5,069,288 | A | 12/1991 | Singeetham | |
| 5,249,629 | A | 10/1993 | Jennings | |
| 5,325,925 | A * | 7/1994 | Smith | E21B 33/04 166/368 |
| 5,456,321 | A * | 10/1995 | Shiach | E21B 33/04 166/382 |
| 7,231,970 | B2 | 6/2007 | Matusek et al. | |
| 8,973,653 | B2 | 3/2015 | Thornburrow et al. | |
| 2011/0253389 | A1 * | 10/2011 | Nguyen | E21B 33/04 166/382 |
| 2013/0206427 | A1 | 8/2013 | Reimert et al. | |
| 2015/0101830 | A1 | 4/2015 | Sommerfeld et al. | |
| 2015/0300111 | A1 | 10/2015 | Ewing et al. | |
| 2016/0186523 | A1 * | 6/2016 | Nguyen | E21B 33/04 166/382 |

FOREIGN PATENT DOCUMENTS

EP 2518260 A1 10/2012

* cited by examiner

*Primary Examiner* — Matthew R Buck
*Assistant Examiner* — Patrick F Lambe
(74) *Attorney, Agent, or Firm* — Helene Raybaud

(57) ABSTRACT

A system includes a hanger running tool that has a first lock ring configured to secure the hanger running tool to a hanger when a first axial force is applied to the hanger running tool and a tool body configured to direct a push ring of the hanger in an axial direction when a second axial force is applied to the hanger running tool, where the push ring is configured to direct a second lock ring of the hanger radially outward toward a tubular, and where the hanger running tool is configured to secure the hanger to the tubular without rotating the hanger running tool.

20 Claims, 19 Drawing Sheets

HANGER RUNNING TOOL AND HANGER

CROSS-REFERENCE TO RELATED APPLICATION

This application is a continuation of U.S. application Ser. No. 15/455,089 entitled "Hanger Running Tool and Hanger," filed on Mar. 9, 2017, which is hereby incorporated by reference in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies generally include a wide variety of components and/or conduits, such as blowout preventers (BOPs), as well as various control lines, casings, valves, and the like, that control drilling and/or extraction operations. Hangers (e.g., tubing hangers or casing hangers) may be used to support sections or strings of casing or tubing within a wellhead assembly. Hangers are typically installed by a tool (e.g., a hanger running tool). Unfortunately, the tool may be complex and/or costly to machine and operate.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The presently disclosed embodiments include a hydraulically actuated hanger and a hanger running tool capable of installing the hanger within a wellhead assembly using axial force and without utilizing rotational force. Installing the hanger without rotational force may reduce the time and cost associated with manufacturing the hanger and/or the hanger running tool (e.g., eliminates the machining of threads in the hanger and/or the hanger running tool). Additionally, the time and complexity of running such a tool into the wellhead assembly may also be improved. Specifically, in the disclosed embodiments, a first axial force may be applied to the hanger running tool to actuate a first lock ring (e.g., a first radial locking dog or another suitable locking component) that secures the running tool to the hanger, and a second axial force may be applied to the hanger running tool to actuate a second lock ring (e.g., a second radial locking dog or another suitable locking component) that secures the hanger to the casing spool. In some embodiments, the first and second axial forces may be applied through a hydraulic piston and/or physical axial force applied to the hanger running tool via a drive or another suitable technique. Subsequently, the hanger running tool may be released from the hanger by releasing the lock ring between the running tool and the hanger, while the lock ring between the hanger and the casing spool remains in place. The running tool may then be retrieved from the wellhead assembly.

Figure 1:
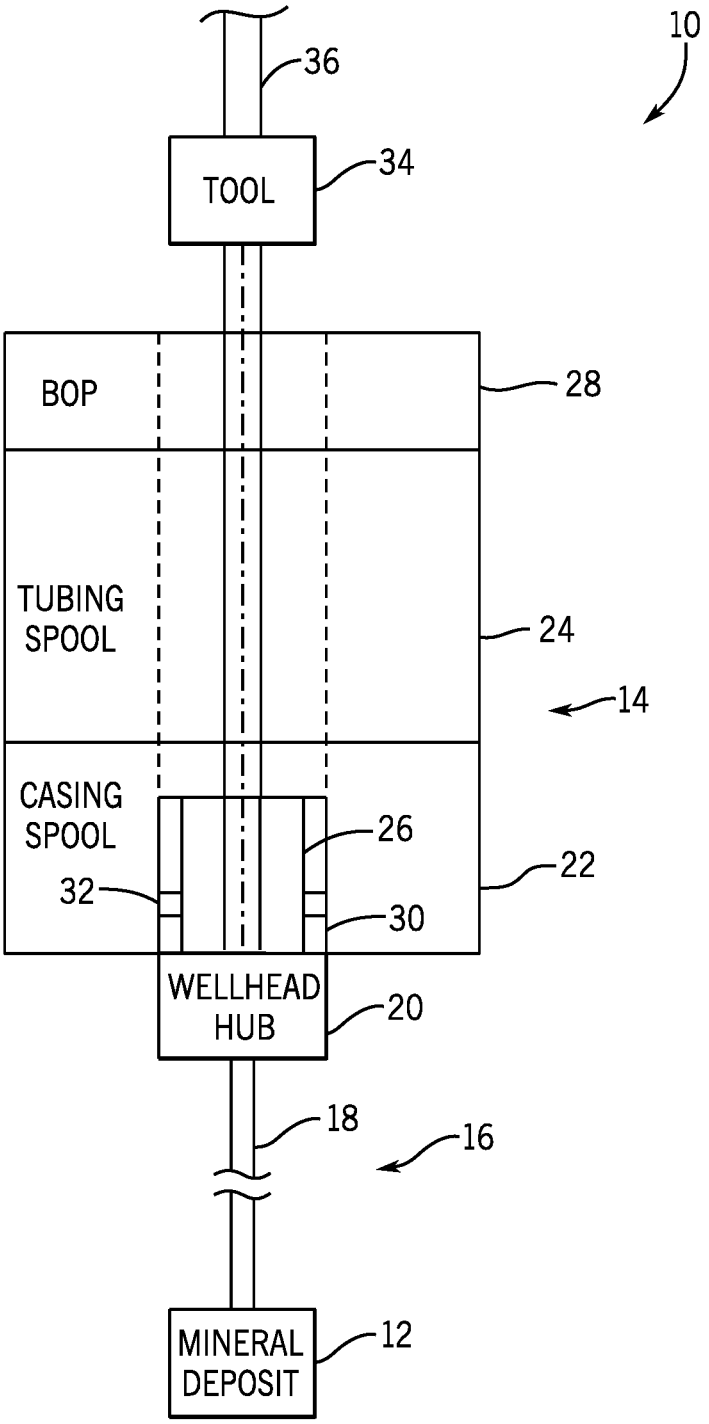
FIG. 1 is a schematic of an embodiment of a mineral extraction system, in accordance with an aspect of the present disclosure.

FIG. 1 is a schematic of an exemplary mineral extraction system 10 configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the reservoir 12 to a wellhead hub 20 located at or near the surface.

The illustrated wellhead hub 20, which may be a large diameter hub, acts as an early junction between the well 16 and the equipment located above the well 16. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the well bore 18, provide for regulating pressure in the well 16, and provide for the injection of chemicals into the well bore 18 (downhole). In the illustrated embodiment, the wellhead 14 includes a casing spool 22 (e.g., tubular), a tubing spool 24 (e.g., tubular), a hanger 26 (e.g., a tubing hanger or a casing hanger), and a blowout preventer (BOP) 28.

In operation, the wellhead 14 enables completion and workover procedures, such as tool insertion into the well 16 for installation and removal of various components (e.g., hangers, shoulders, etc.). Further, minerals extracted from the well 16 (e.g., oil and natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the well bore 18 for various completion and workover procedures, such as emplacing tools or components within the casing spool 22. To emplace the components, a shoulder 32 provides a temporary or permanent landing surface that can support pieces of equipment (e.g., hangers). For example, the illustrated embodiment of the extraction system 10 includes a tool 34 suspended from a drill string 36. In certain embodiments, the tool 34 may include running tools (e.g., hanger running tools, shoulder running tools, slip tools, etc.) that are lowered (e.g., run) to the well 16, the wellhead 14, and the like. The hanger 26 may be installed on the shoulder 32 and used to support sections of casing or tubing within the wellhead assembly 14.

Figure 2:
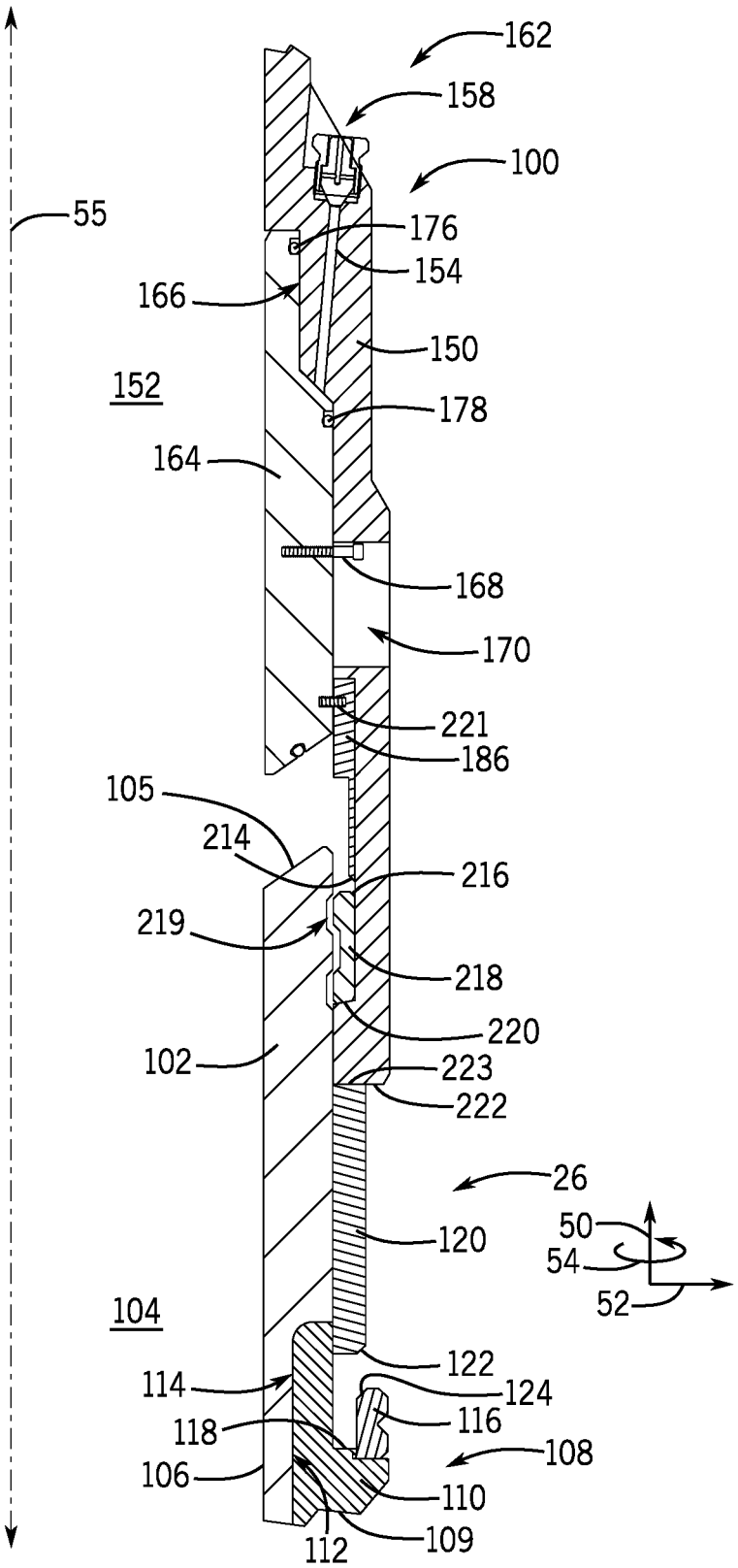
FIG. 2 is a partial, cross-section view of an embodiment of a hanger running tool being coupled to a hanger for installation in a wellhead assembly, in accordance with an aspect of the present disclosure.

FIG. 2 is a partial, cross-section of a hanger running tool 100 being coupled to the hanger 26 for installation in the wellhead assembly 14. The hanger running tool 100 is coupled to the hanger 26 before the tool 100 is inserted into the wellhead assembly 14. For example, the hanger running tool 100 may be coupled to the hanger 26 on the rig floor. For reference, a coordinate system is shown comprising an axial direction or axis 50, a radial direction or axis 52, and a circumferential direction or axis 54 relative to a central axis 55. It should be noted that FIGS. 2-18 are cross-sections of embodiments of the hanger running tool on only a right-hand side of the central axis 55. Unless stated otherwise, each illustrated feature of FIGS. 2-18 is annular and extends circumferentially about the central axis 55.

In some embodiments, the hanger 26 may include a generally annular body 102, which defines a bore 104, an upper tapered annular shoulder 105, and a lower mounting interface 106 (e.g., threaded interface), which may be used to hang a tubular. Proximate an axial end 108 (e.g., downhole end) of the body 102 is a lip 109 (e.g., a radially protruding annular flange, shoulder, or surface). Disposed about the body 102 is an annular preload ring 110. The preload ring 110 may have an interior threaded surface 112 that engages with an exterior threaded surface 114 of the body 102 to hold the preload ring 110 in place relative to the body 102. Additionally, a lock ring 116 may be disposed about the body 102 and the preload ring 110, and may rest upon a lip 118 (e.g., a radially protruding annular lip or annular surface) of the preload ring 110. A push ring 120 may be disposed about the body 102. The push ring 120 may have a tapered surface 122 (e.g., a tapered annular surface, a conical surface, or another energizing taper portion) that interfaces with a corresponding tapered surface 124 (e.g., a tapered annular surface, a conical surface, or another energizing taper portion) of the lock ring 116 such that when the push ring 120 moves in the axial direction 50 toward the lock ring 116, the lock ring 116 expands radially outward (e.g., in the radial direction 52). Correspondingly, when the push ring 120 moves in the axial direction 50 away from the lock ring 116, the lock ring 116 may radially contract (e.g., in the radial direction 52) toward the preload ring 110 and/or the body 102.

The hanger running tool 100 may include an annular body 150, which defines a bore 152. The body 150 also defines a fluid passage 154, which may be pressurized by a pressurized fluid (e.g., hydraulic pressure applied by a hydraulic fluid, pneumatic pressure applied by a pneumatic fluid, etc.) in order to actuate various components of the hanger running tool 100. The first fluid passage 154 may be in fluid communication with a first pressure port 158 disposed at a first axial end 162 of the hanger running tool 100. Fluid (e.g., air, hydraulic fluid, oil, water, etc.) in the first passage 154 may be pressurized from one or more pressurized fluid sources (e.g., fluid pumps, tanks, accumulators, etc.) by applying a pressure via the first pressure port 158.

The hanger running tool 100 may further include a piston 164, which may be generally annular in shape (e.g., annular piston) and disposed on an inner surface 166 of the body 150. Additionally, the piston 164 may include a guide screw 168 that may couple the piston 164 to the body 150 as well as enable the piston 164 to move in the axial direction 50 along the inner surface 166. Accordingly, the body 150 may include a slot 170 (e.g., an annular slot extending circumferentially about the central axis 55) that is configured to receive the guide screw 168 and guide the piston 164 in the axial direction 50. The piston 164 may include a first interior seals 176 (e.g., o-ring) that forms a seal with the body 150 and a second interior seal 178, which also forms a seal with the body 150.

The piston 164 may be coupled to a push member 186 (e.g., linkages, rods, sleeves, or elongated structures), which may include a tapered surface 214 (e.g., an annular tapered surface, a conical surface, or another energizing taper portion) that interfaces with a corresponding tapered surface 216 (e.g., an annular tapered surface, a conical surface, or another energizing taper portion) of a lock ring 218 (e.g., annular lock ring) of the hanger running tool 100. In some embodiments, the lock ring 218 rests on a lip 220 (e.g., annular lip surface) of the body 150. The tapered surface 214 interfaces with the corresponding tapered surface 216 such that as the piston 164 moves downward in the axial direction 50, the lock ring 218 contracts radially inward from an unlocked position toward a loaded position relative to a lock ring groove 219 of the hanger 26. Correspondingly, when the piston 164 moves upward in the axial direction 50, the lock ring 218 expands radially outward from the loaded position toward the unlocked position relative to the lock ring groove 219 of the hanger 26. In some embodiments, the push member 186 may be coupled to the piston 164 via a fastener 221 (e.g., a screw, a bolt, and/or another suitable fastening device).

As shown in the illustrated embodiment of FIG. 2, the body 150 of the hanger running tool 100 lands on the body 102 of the hanger 26. In particular, a landing surface 222 of the body 150 lands on a landing surface 223 of the push ring 120. In particular, once the hanger running tool 100 has landed on the hanger 26, a pressure (e.g., a hydraulic or pneumatic pressure) may be applied via the first pressure port 158 in order to couple the hanger running tool 100 to the hanger 26. Specifically, when a pressure is applied to the first passage 154 via the first pressure port 158, the pressure may direct the piston 164 downward in the axial direction 50.

Figure 3:
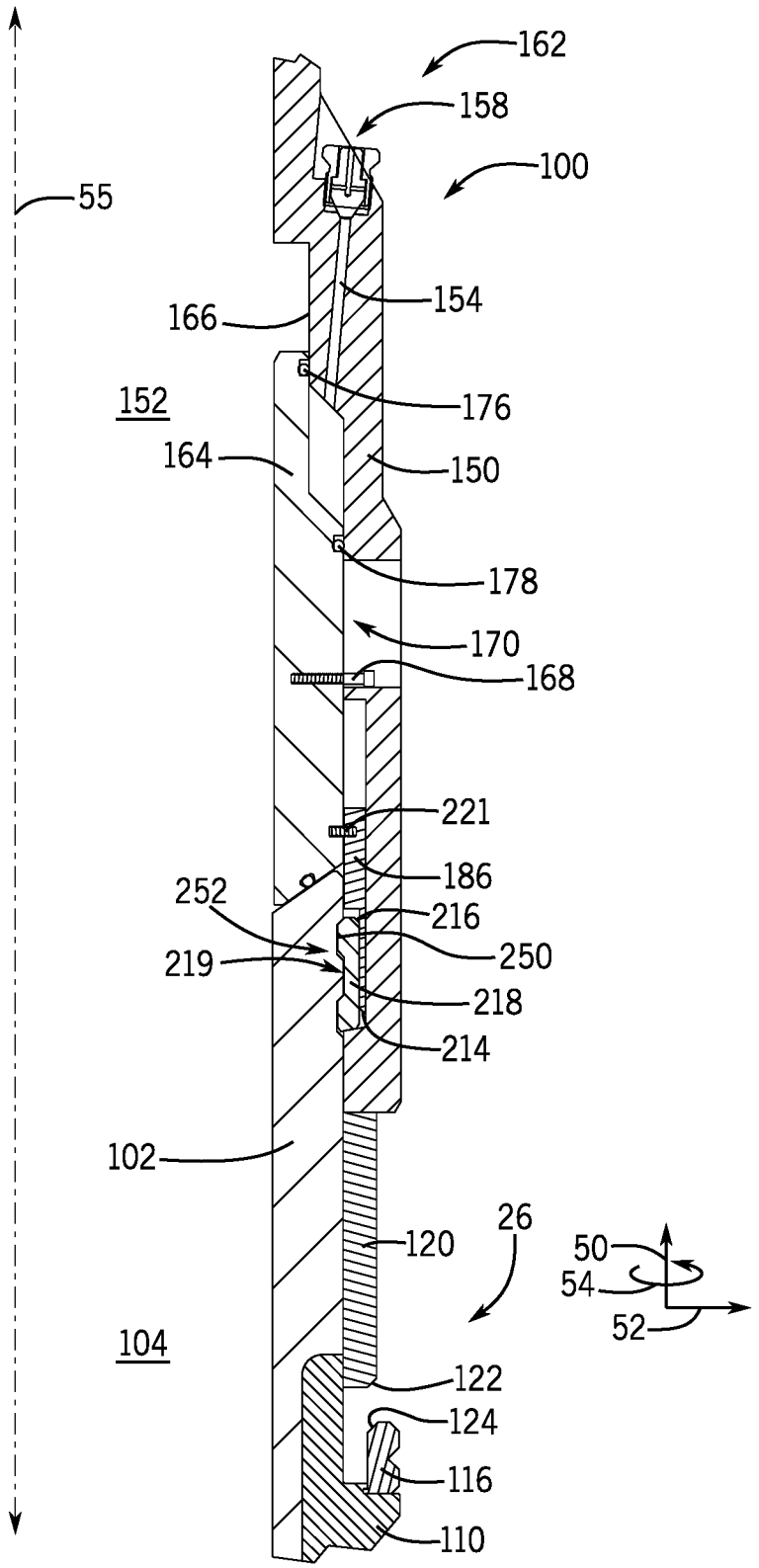
FIG. 3 is a partial, cross-section view of an embodiment of the hanger running tool of FIG. 2 when a first axial force is applied to the hanger running tool, in accordance with an aspect of the present disclosure.

For example, FIG. 3 is a partial, cross-section view of the hanger running tool 100 and the hanger 26 when the piston 164 is directed downward in the axial direction 50. As the piston 164 moves axially downward, the tapered surface 214 of the push member 186 interfaces with the corresponding tapered surface 216 of the lock ring 218 to push the lock ring 218 radially inward against the body 102 of the hanger 26 from the unlocked position (e.g., FIG. 2) to the locked position (e.g., FIG. 3). As shown, an interior surface 250 of the lock ring 218 may have contours (e.g., teeth or ridges and grooves or recesses) that align with corresponding contours (e.g., teeth or ridges and grooves or recesses) in the groove 219 along an exterior surface 252 of the hanger body 102, such that when the lock ring 218 contracts in the radial direction 52, the hanger running tool 100 couples to the hanger 26. The surface 250 of the load ring 218 and the surface 252 of the groove 219 may include annular structures (e.g., teeth, ridges, grooves, or recesses) and/or circumferentially spaced structures. Once coupled together, the lock ring 218 in the groove 219 may block axial movement, radial movement, and/or circumferential movement between the tool 100 and the hanger 26.

Figure 4:
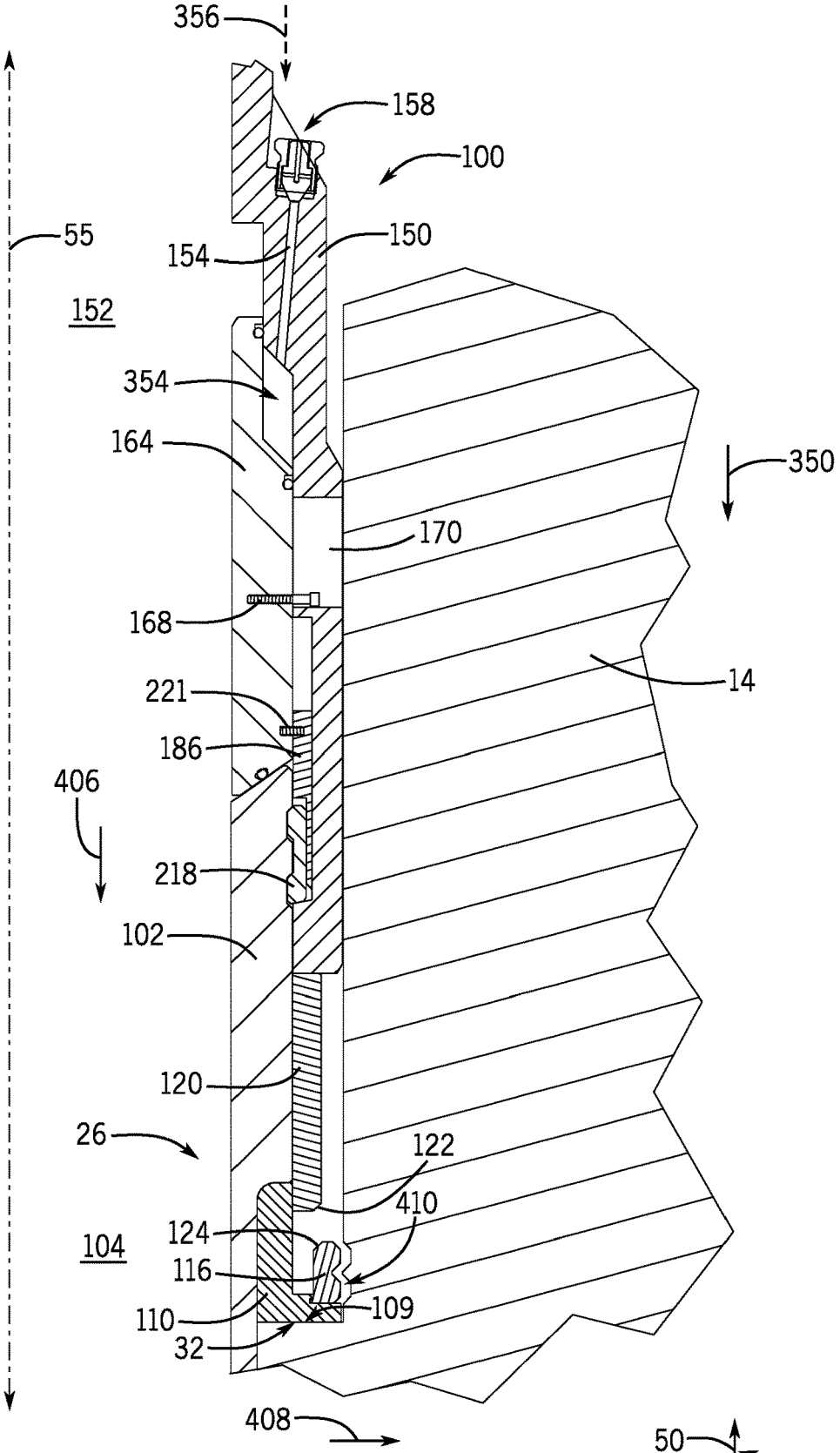
FIG. 4 is a partial, cross-section view of an embodiment of the hanger running tool of FIG. 2 coupled to the hanger and disposed in the wellhead assembly, in accordance with an aspect of the present disclosure.

FIG. 4 is a partial, cross-section view of the hanger running tool 100 and hanger 26 inserted into the wellhead assembly 14. As shown, the hanger running tool 100 and hanger 26 are inserted into the well head assembly 14 in the axial direction 50, as indicated by arrow 350, until the lip 109 of the hanger 26 lands on the shoulder 32 (e.g., tapered annular landing shoulder or a conical surface) of the casing spool 22. In some embodiments, the first pressure port 158 may be opened when the hanger 26 is positioned on the shoulder 32, such that pressure between the piston 164 and the body 150 of the hanger running tool 100 is reduced. Relieving pressure in a cavity 354 between the piston 164 and the body 150 (e.g., formed when pressure is applied to the first passage 154), may enable movement between the body 150 with respect to the piston 164, which thus enables the hanger running tool 100 to secure the hanger 26 into the casing spool 22.

For example, once the lip 109 of the hanger 26 has landed on the shoulder 32 and the pressure is relieved in the cavity 354, the hanger 26 may be installed by actuating the lock ring 116. An axial force 356 may be applied to the hanger running tool 100 (e.g., via a drive and/or a physical force), such that the push ring 120 of the hanger 26 is directed axially downward by the body 150 of the hanger running tool 100, as indicated by arrow 406. For example, in some embodiments, the axial force 356 may be applied by an actuator, such as a hydraulic actuator, a pneumonic actuator, an electric actuator, or another suitable device. In any case, the body 150 of the hanger running tool 100 thus moves in the axial direction 50 independent of the piston 164, and such movement is enabled because the first pressure port 158 is open, thereby relieving pressure in the cavity 354. As the push ring 120 of the hanger 26 moves axially downward, the tapered surface 122 (e.g., energizing taper portion) of the push ring 120 interfaces with the corresponding tapered surface 124 (e.g., energizing taper portion) of the lock ring 116 to push the lock ring 116 radially outward, as indicated by arrow 408, into an annular recess 410 of the casing spool 22. When the lock ring 116 is disposed in the annular recess 410 of the casing spool 22, relative axial movement between the casing spool 22 and the hanger 26 is restricted.

Figure 5:
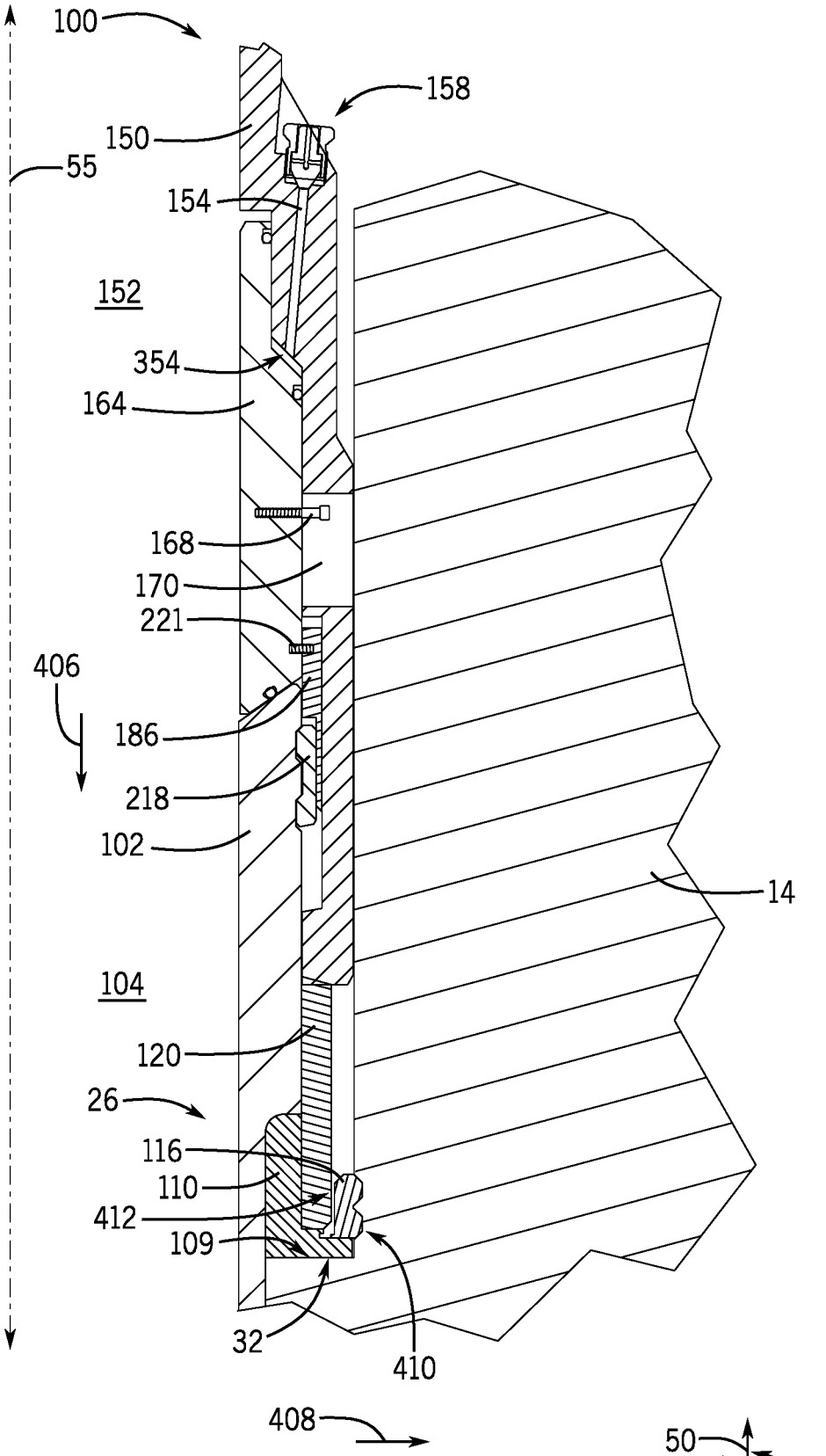
FIG. 5 is a partial, cross-section view of an embodiment of the hanger running tool of FIG. 2 when a second axial force is applied to the hanger running tool to secure the hanger to a tubular in the wellhead assembly, in accordance with an aspect of the present disclosure.

For example, FIG. 5 is a partial, cross-section view of the hanger 26 engaged with the casing spool 22. Specifically, FIG. 5 illustrates a locked position of the lock ring 116 in the recess 410. As illustrated, the push ring 120 of the hanger 26 is in a lowered position, pushing the lock ring 116 radially outward into the annular recess 410 of the casing spool 22, such that relative axial movement between the casing spool 22 and the hanger 26 is restricted. In the locked position, the push ring 120 extends around and at least partially axially overlaps the lock ring 116, such that the push ring 120 blocks contraction of the lock ring 116 radially out of the annular recess 410. In particular, a portion 412 (e.g., annular hold down portion) of the push ring 120 may extend concentrically about the lock ring 116 to hold the lock ring 116 within the annular recess 410, and thus hold the hanger 26 in a locked position with the casing spool 22.

Figure 6:
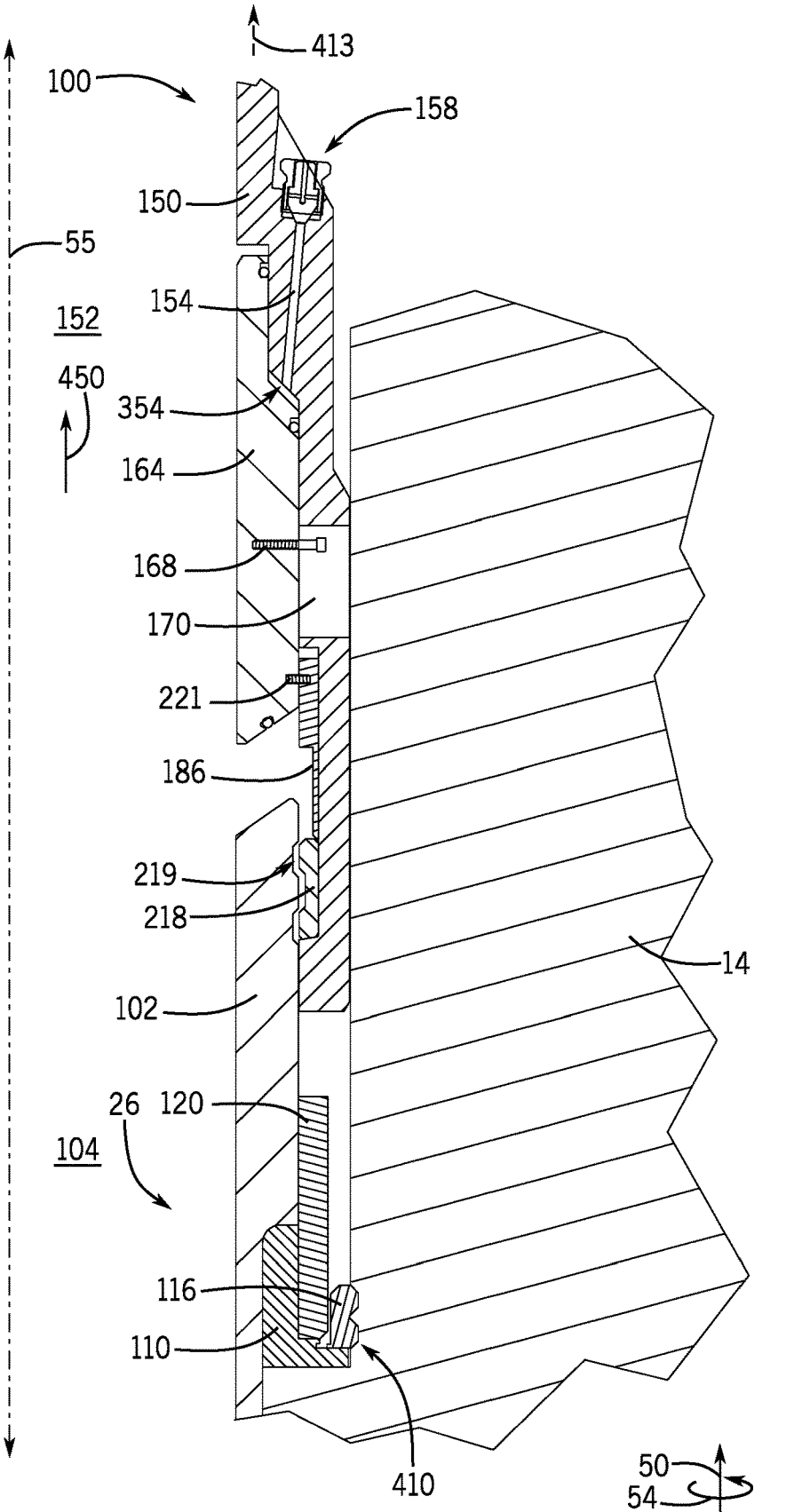
FIG. 6 is a partial, cross-section view of an embodiment of the hanger running tool of FIG. 2 being de-coupled from the hanger, in accordance with an aspect of the present disclosure.

Once the hanger 26 has been coupled to the casing spool 22, the hanger running tool 100 may release the hanger 26. FIG. 6 is a partial, cross-section view illustrating disengagement of a locked position of the hanger running tool 100 with the hanger 26. To decouple the hanger running tool 100 from the hanger 26, the first pressure port 158 may be closed, thereby enclosing any fluid (e.g., hydraulic fluid) in the cavity 354. Subsequently, a second axial force 413 may be applied to the hanger running tool 100 to drive the body 150 axially upward, as indicated by arrow 450. Closing the first pressure port 158 hydraulically secures the piston 164 to the body 150, such that the piston 164 moves axially upward with the body 150, as indicated by arrow 450. As the piston 164 moves axially upward, the push member 186 is also directed axially upward (e.g., as indicated by the arrow 450), which thus enables the lock ring 218 to automatically expand out of the groove 219, thereby releasing or unlocking the tool 100 from the hanger 26. Specifically, the push member 186 no longer holds the lock ring 218 in the groove 219 because the push member 186 no longer axially overlaps with the lock ring 218, thereby enabling the lock ring 218 to radially expand.

Figure 7:
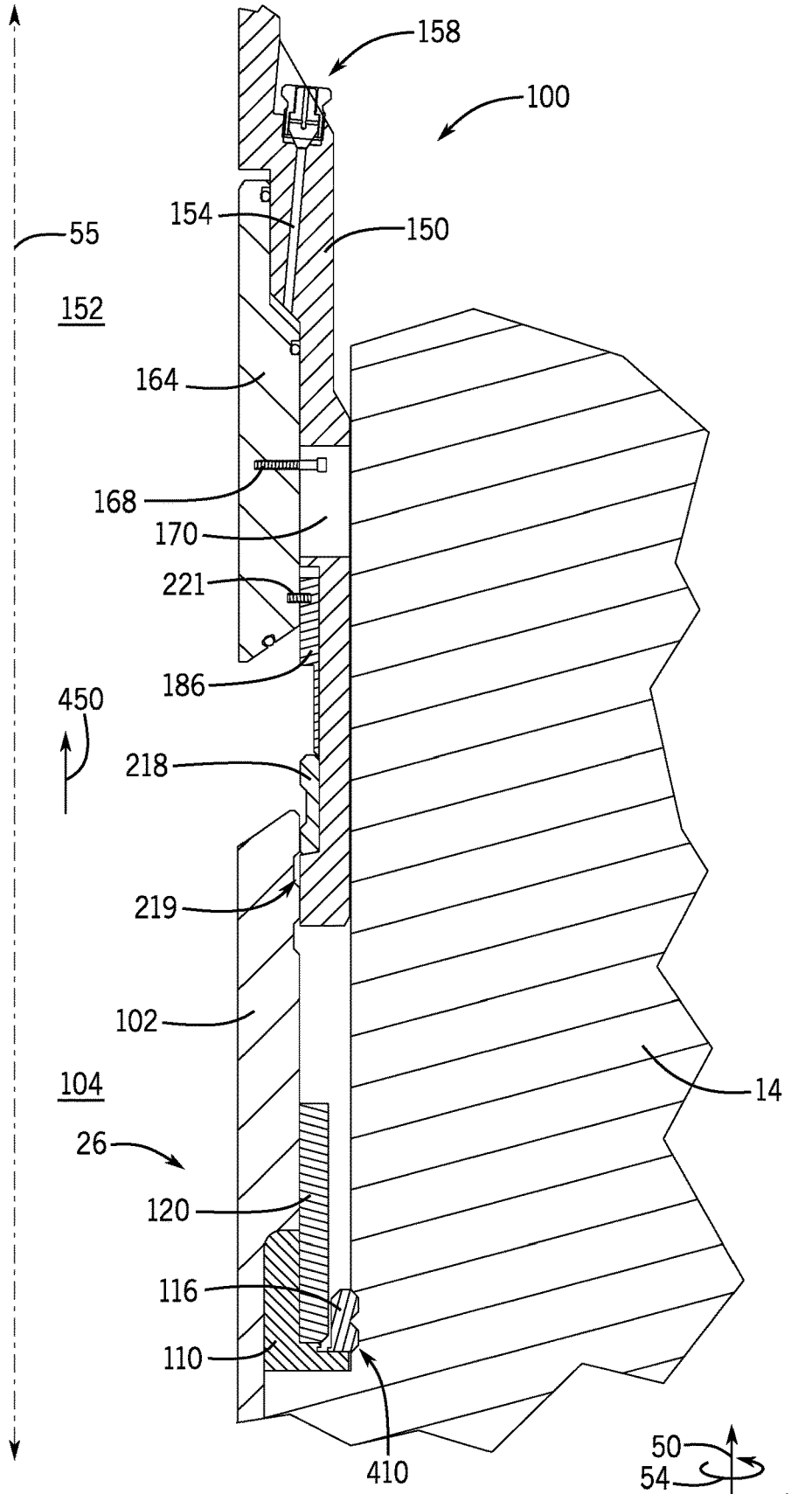
FIG. 7 is a partial, cross-section view of an embodiment of the hanger running tool of FIG. 2 being removed from the wellhead assembly, in accordance with an aspect of the present disclosure.

FIG. 7 is a partial, cross-section view of the hanger running tool 100 decoupled from the hanger 26 (i.e., unlocked position) and being removed from the wellbore 14. As illustrated, the piston 164 is in an elevated position, and thus, the push member 186 does not concentrically overlap with the lock ring 218, enabling movement of the lock ring 218 in the axial direction 50 (e.g., the upward axial direction indicated by arrow 450). When the lock ring 218 is in this unlocked position, the hanger running tool 100 may be retrieved from the wellhead assembly 14, while the hanger 26 remains locked in position with the casing spool 22.

Figure 8:
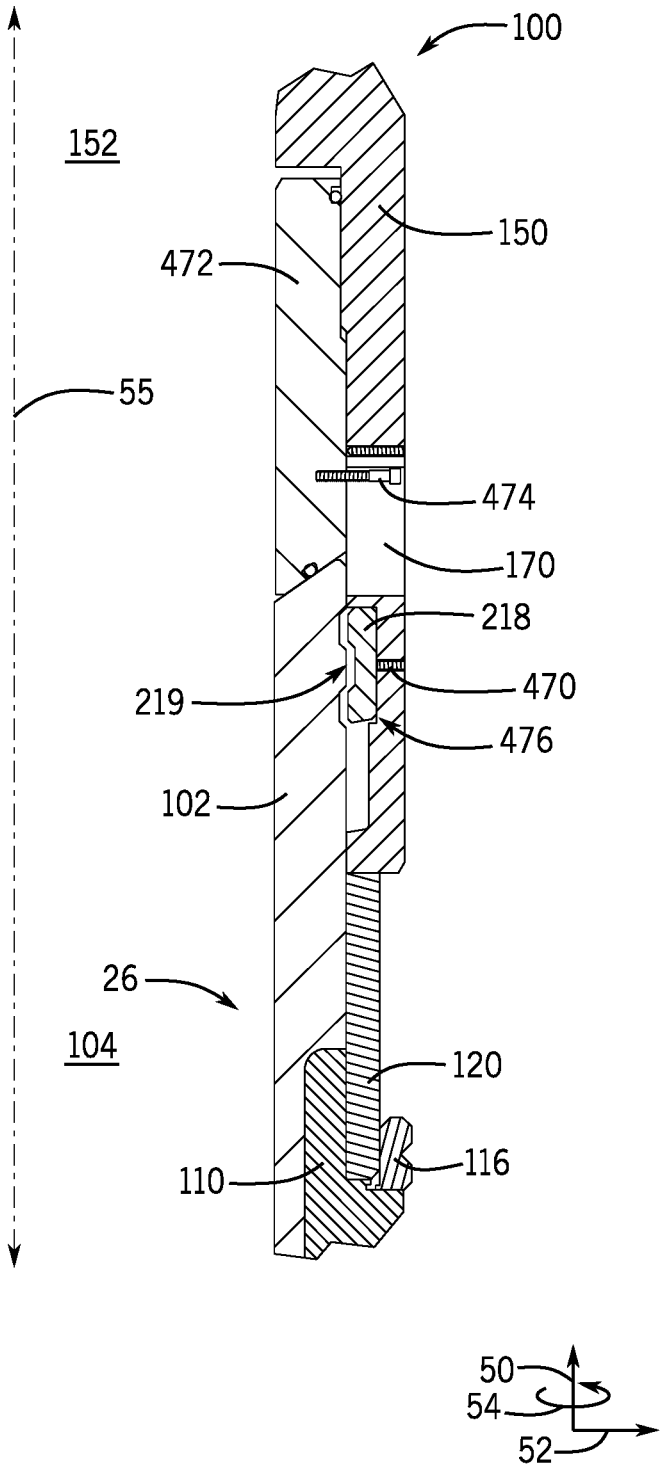
FIG. 8 is a partial, cross-section view of an embodiment of the hanger running tool being coupled to the hanger for installation in the wellhead assembly, in accordance with an aspect of the present disclosure.

While the present discussion has focused on utilizing hydraulic pressure to drive at least some of the axial movement of the hanger running tool 100, it should be understood, that in other embodiments, the axial movement of the hanger running tool 100 may be purely mechanical (e.g., not driven by hydraulic pressure). For example, FIG. 8 is a partial, cross-section view of an embodiment of the hanger running tool 100 that does not utilize hydraulic pressure to drive axial movement of the hanger running tool 100 (or components of the hanger running tool 100). As shown in the illustrated embodiment of FIG. 8, the hanger running tool 100 may include a lock screw 470 (e.g., a fastener such as a threaded screw, a threaded bolt, or another suitable fastening device) disposed in the body 150. The lock screw 470 may be utilized to secure the hanger running tool 100 to the hanger 26. Additionally, instead of having the piston 164, the hanger running tool 100 may include an inner sleeve 472. In some embodiments, the inner sleeve 472 may be coupled to the body 150 of the hanger running tool 100 via a fastener 474 (e.g., a screw, a bolt, etc.). The fastener 474 may be disposed in the slot 170 of the body 150. Accordingly, the inner sleeve 472 may be configured to move in the axial direction 50 independent of the body 150.

As shown in the illustrated embodiment of FIG. 8, the lock ring 218 of the hanger running tool 100 may be disposed in a recess 476 of the body 150 in a default position (e.g., before the hanger running tool 100 is secured to the hanger 26). As discussed above, the lock ring 218 may be biased radially outward toward the body 150 of the hanger running tool 100. Accordingly, the lock screw 470 may be utilized (e.g., rotated along threaded interface) to drive the lock ring 218 radially inward into the groove 219 of the hanger 26.

Figure 9:
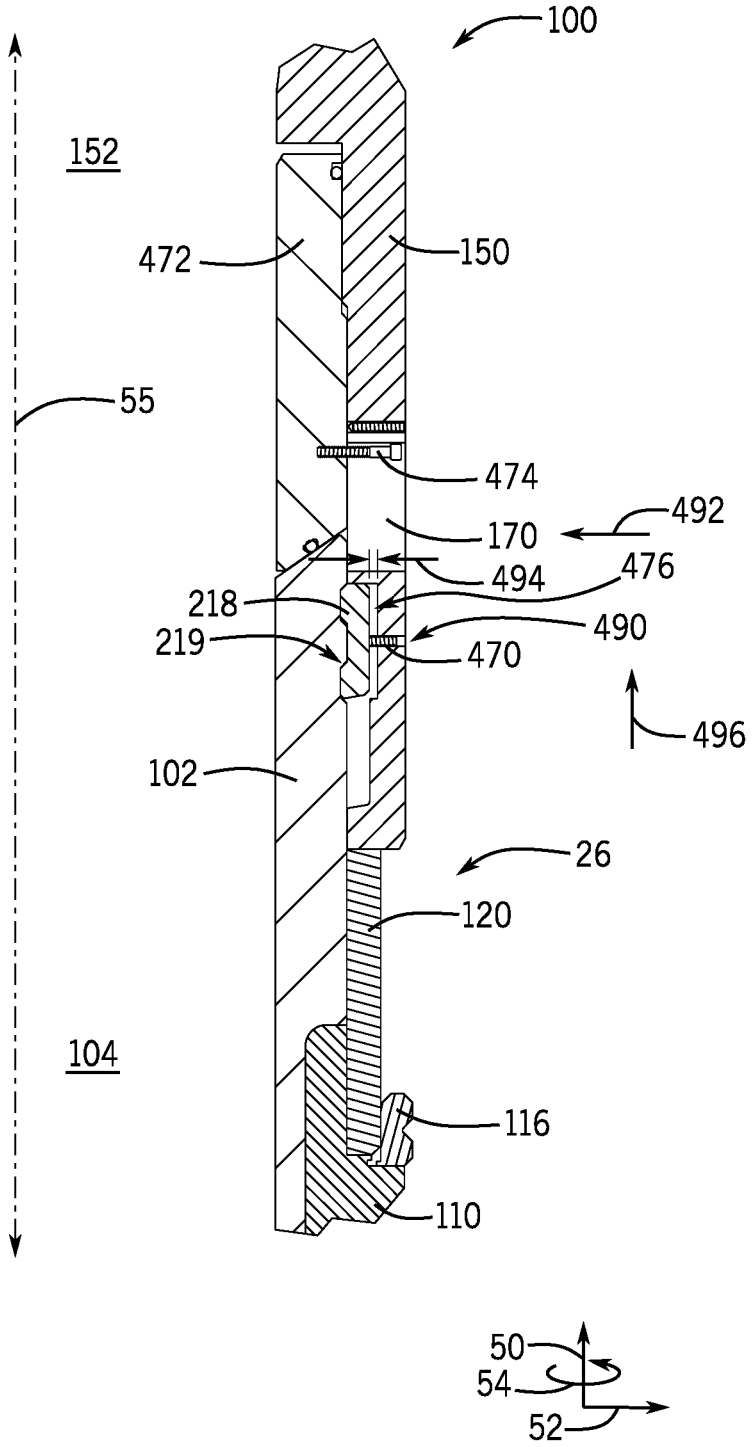
FIG. 9 is a partial, cross-section view of an embodiment of the hanger running tool of FIG. 8 with a lock screw directing a lock ring of the hanger running tool into a corresponding groove of the hanger, in accordance with an aspect of the present disclosure.

For example, FIG. 9 is a partial, cross-section view of the hanger running tool 100 secured to the hanger 26 by the lock ring 218. As shown in the illustrated embodiment of FIG. 9, the lock screw 470 is directed in the radial direction 52 within an opening 490 of the hanger body 150, as shown by arrow 492. Accordingly, the lock screw 470 may drive the lock ring 218 in the radial direction 52 and into the groove 219, as shown by arrow 492. The lock ring 218 may thus be moved out of the recess 476 and into the groove 219, thereby creating a gap 494 between the lock ring 218 and the body 150 of the hanger running tool 100.

Figure 10:
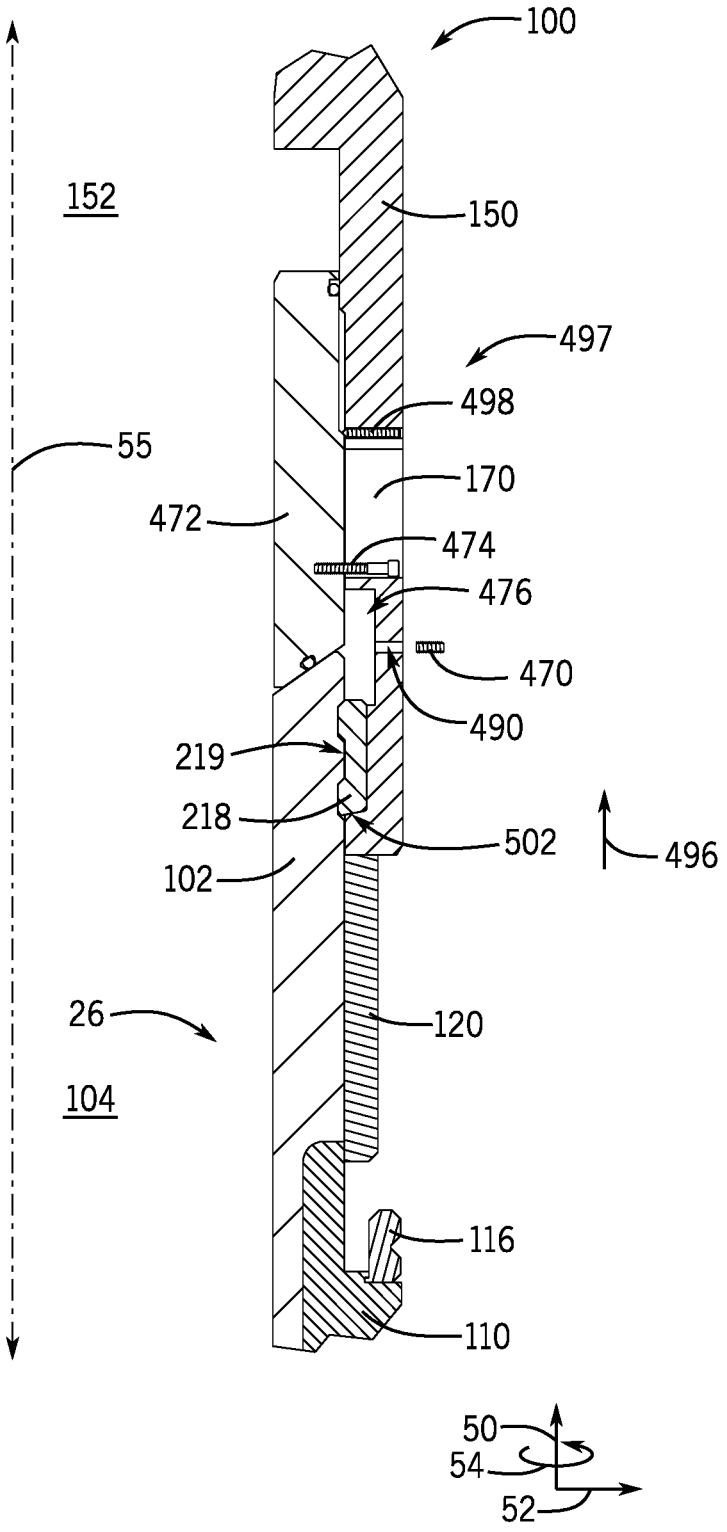
FIG. 10 is a partial, cross-section view of an embodiment of the hanger running tool of FIG. 8 when a first axial force is applied to the hanger running tool to secure the hanger running tool to the hanger, in accordance with an aspect of the present disclosure.

To further secure the lock ring 218 in the groove 219, and thus, the hanger running tool 100 to the hanger 26, an axial force may be applied to the hanger running tool 100 (e.g., via a mechanical actuator, gravitational actuator, hydraulic actuator, a pneumatic actuator, an electric actuator, or another suitable device) to direct the body 150 of the hanger running tool 100 in the upward axial direction 50, as shown by arrow 496. For example, FIG. 10 is a partial, cross-section view of the hanger running tool 100 secured to the hanger 26. The body 150 is in an upward position 497, such that the lock ring 218 rests on a lip 502 of the body 150. The lock screw 470 may be removed because the lock ring 218 is secured in the groove 219 by the body 150 (e.g., the recess 476 does not axially overlap with the lock ring 218, such that the gap 494 does not exist between the lock ring 218 and the body 150). The inner sleeve 472 may be secured in place by an additional lock screw 498 (e.g., a shear pin) that extends through the body 150 and into the inner sleeve 472. Accordingly, movement of the inner sleeve 472 with respect to the body 150 may be blocked by the additional lock screw 498 when the hanger running tool 100 runs the hanger 26 into the wellbore 14.

Additionally, when the hanger running tool 100 is directed in the upward axial direction 50, the push ring 120 of the hanger 26 may also move in the upward axial direction 50, as shown by the arrow 496. For example, when the body 150 does not apply a force to the push ring 120, the lock ring 116 of the hanger 26 may contract radially inward, thereby driving the push ring 120 in the upward axial direction 50, as shown by the arrow 496.

Figure 11:
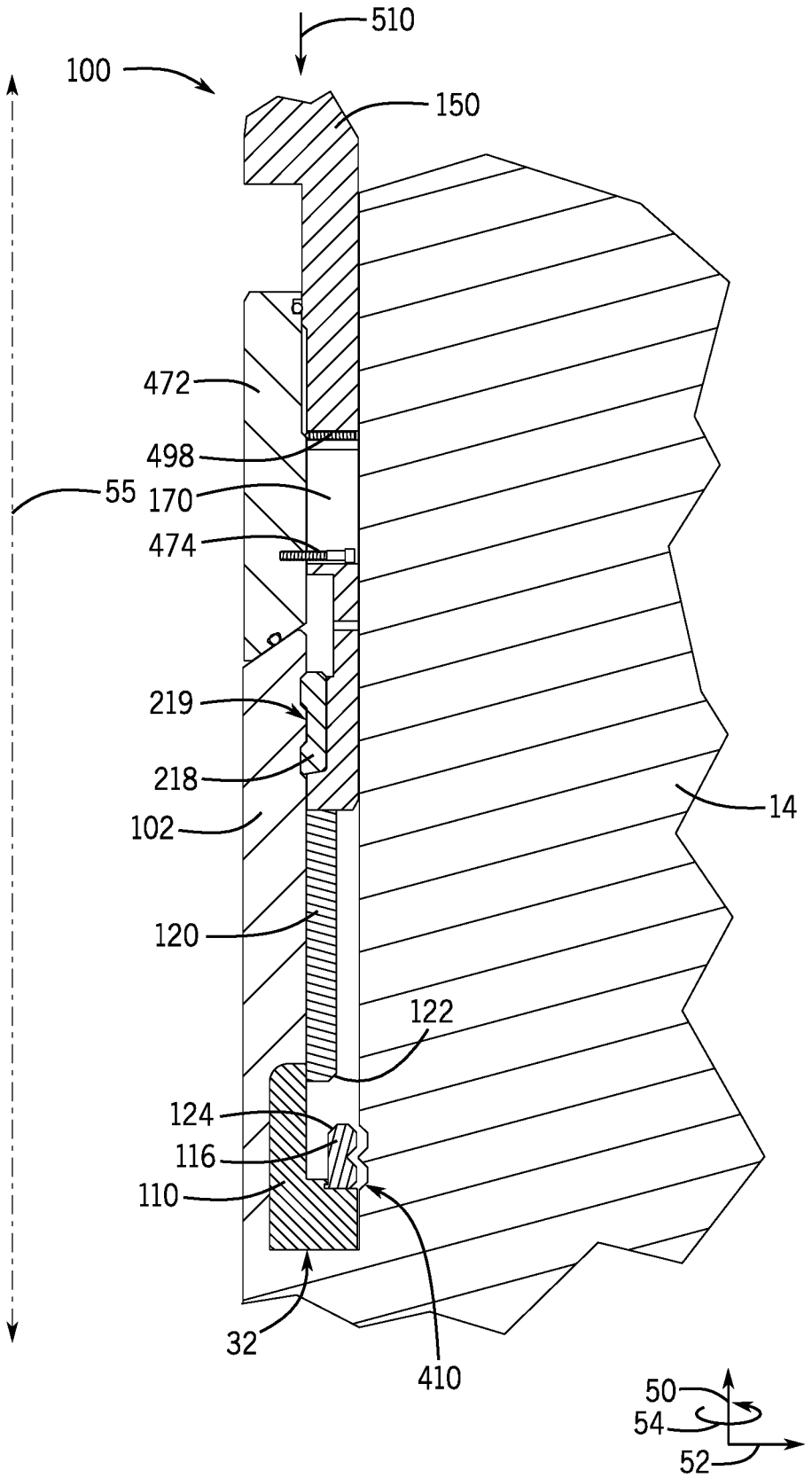
FIG. 11 is a partial, cross-section view of an embodiment of the hanger running tool of FIG. 8 coupled to the hanger and disposed in the wellhead assembly, in accordance with an aspect of the present disclosure.

With the hanger running tool 100 secured to the hanger 26, the hanger running tool 100 and hanger 26 assembly may be disposed in the wellbore 14, as shown in FIG. 11. The hanger running tool 100 may run the hanger 26 into the wellbore 14 and rest the hanger on the shoulder 32. When the hanger 26 is disposed on the shoulder 32, a second axial force (e.g., via a mechanical actuator, gravitational actuator, hydraulic actuator, a pneumatic actuator, an electric actuator, or another suitable device) may be applied to the hanger running tool 100 in the downward axial direction 50, as shown by arrow 510. In some embodiments, the axial force may be applied by a drive (e.g., a mechanical actuator, gravitational actuator, hydraulic actuator, a pneumatic actuator, an electric actuator, or another suitable device) and/or another device configured to exert a physical force on the hanger running tool 100. In any case, when the hanger running tool 100 is directed in the downward axial direction 50, the additional lock screw 498 may shear, thereby enabling the body 150 to move relative to the inner sleeve 472.

Figure 12:
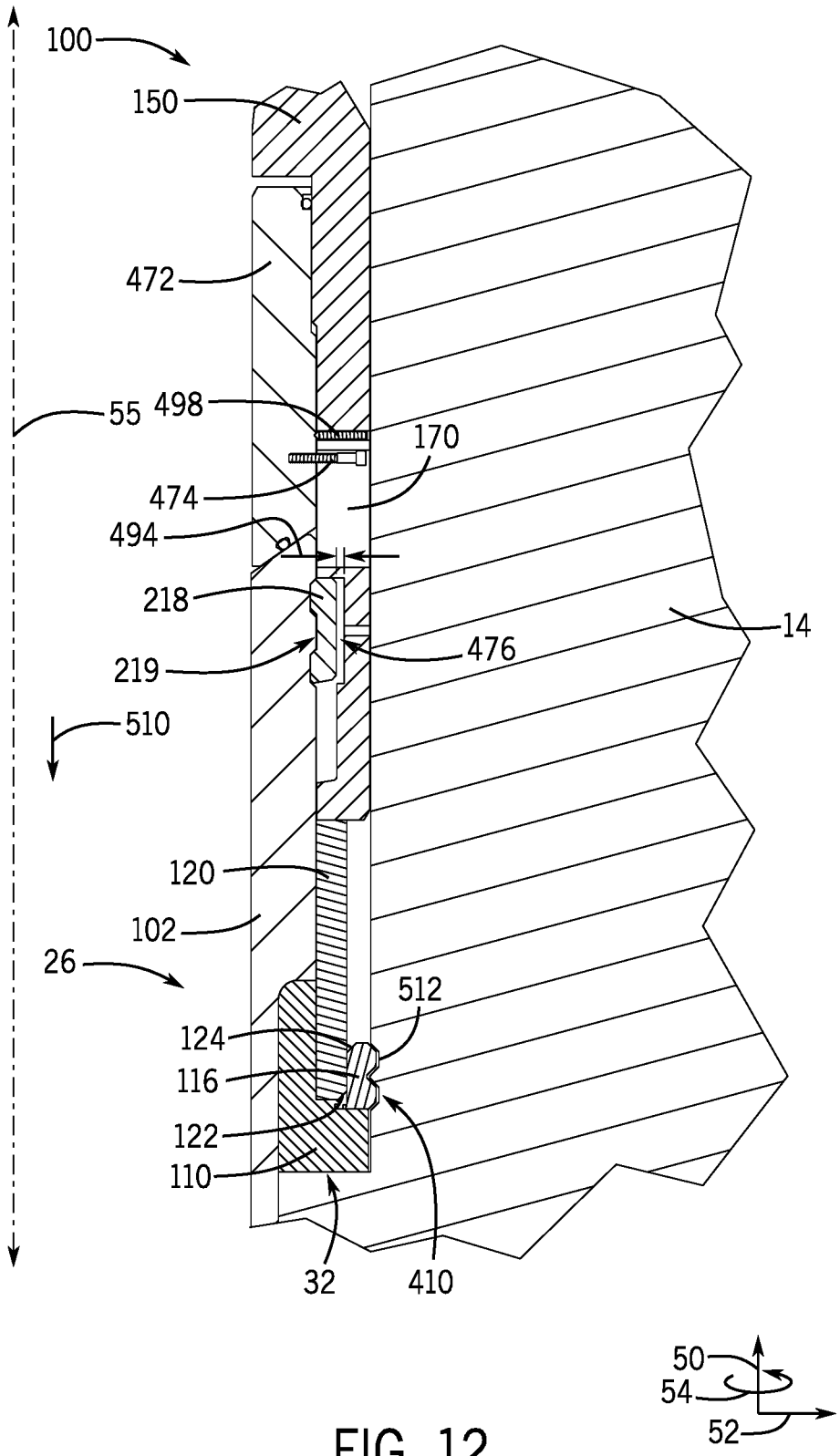
FIG. 12 is a partial, cross-section view of an embodiment of the hanger running tool of FIG. 8 when a second axial force is applied to the hanger running tool to secure the hanger to a tubular in the wellhead assembly, in accordance with an aspect of the present disclosure.

For example, FIG. 12 is a partial, cross-section view of the hanger running tool 100 when the body 150 is directed in the downward axial direction 50, as shown by the arrow 510. When the body 150 moves in the downward axial direction 50, the body 150 may drive the push ring 120 in the downward axial direction 50, as shown by the arrow 510. Accordingly, the tapered surface 122 of the push ring 120 may engage with the tapered surface 124 of the lock ring 116, thereby driving the lock ring 116 radially outward in the radial direction 52 toward the annular recess 410 of the casing spool 22. As discussed above, the shape of the recess 410 of the casing spool 22 may substantially mirror a shape of the lock ring 116. Thus, movement of the lock ring 116 may be blocked in the axial direction 50 by a surface 512 of the recess 410. Additionally, movement of the lock ring 116 may be blocked in the radial direction 52 by the push ring 120 (e.g., the lock ring 116 may apply a force in the radial direction 52 to the push ring 120, which may be blocked from movement by the body 102 of the hanger 26).

Figure 13:
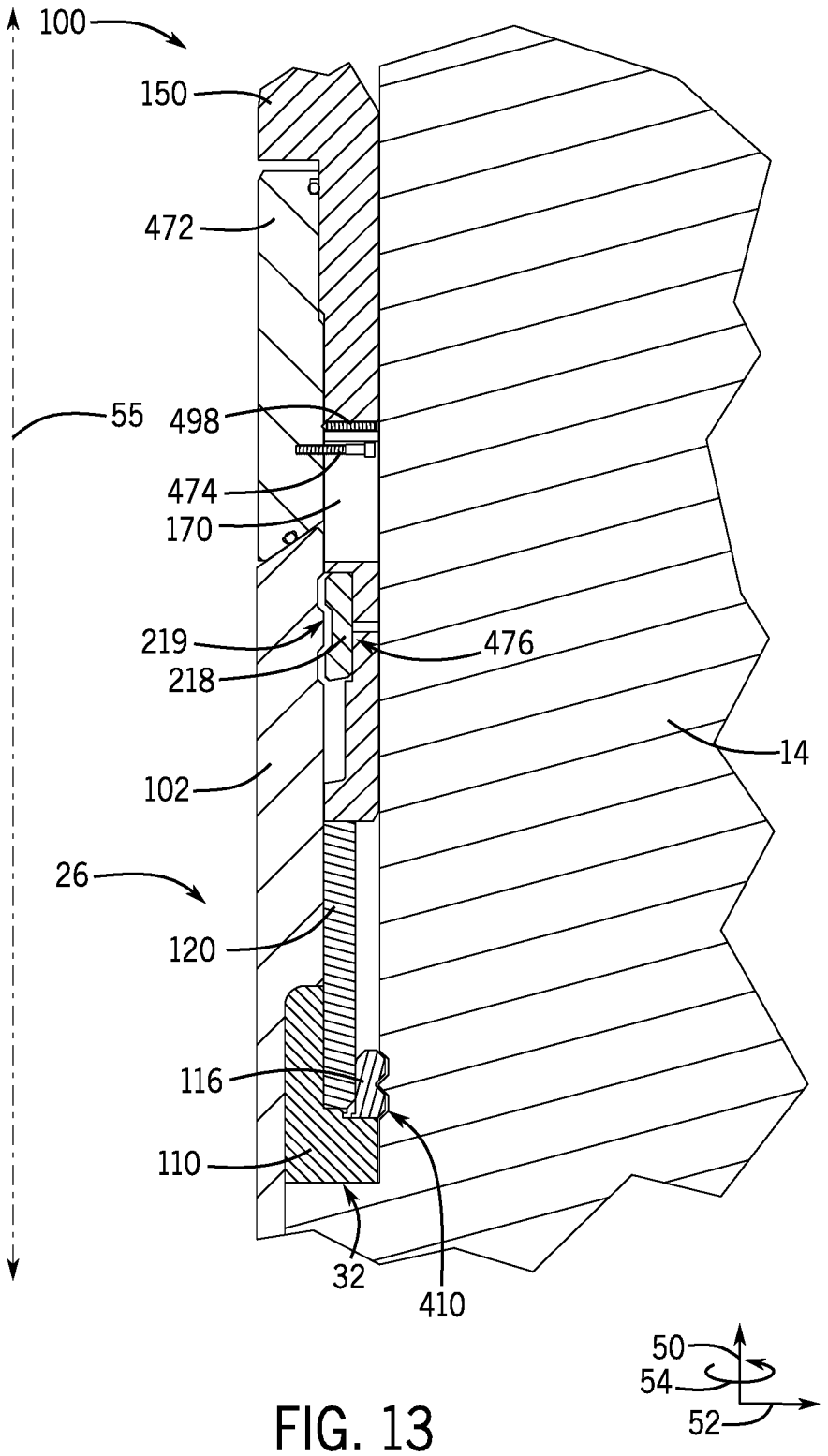
FIG. 13 is a partial, cross-section view of an embodiment of the hanger running tool of FIG. 8 being de-coupled from the hanger, in accordance with an aspect of the present disclosure.

When the lock ring 116 is disposed in the recess 410 of the casing spool 22, the lock ring 218 of the hanger running tool 100 may expand radially outward (e.g., in the radial direction 52) into the recess 476, as shown in FIG. 13. For example, when the body 150 moves in the upward axial direction 50, the recess 476 of the hanger body 150 may be axially aligned with the lock ring 218. Thus, the gap 494 may be present between the lock ring 218 and the body 150 (see, e.g., FIG. 12). Since the lock screw 470 was removed, the lock ring 218 may not have resistance to radial expansion into the recess 476. Accordingly, the lock ring 218 may be disposed in the recess 476, as shown in FIG. 13.

Figure 14:
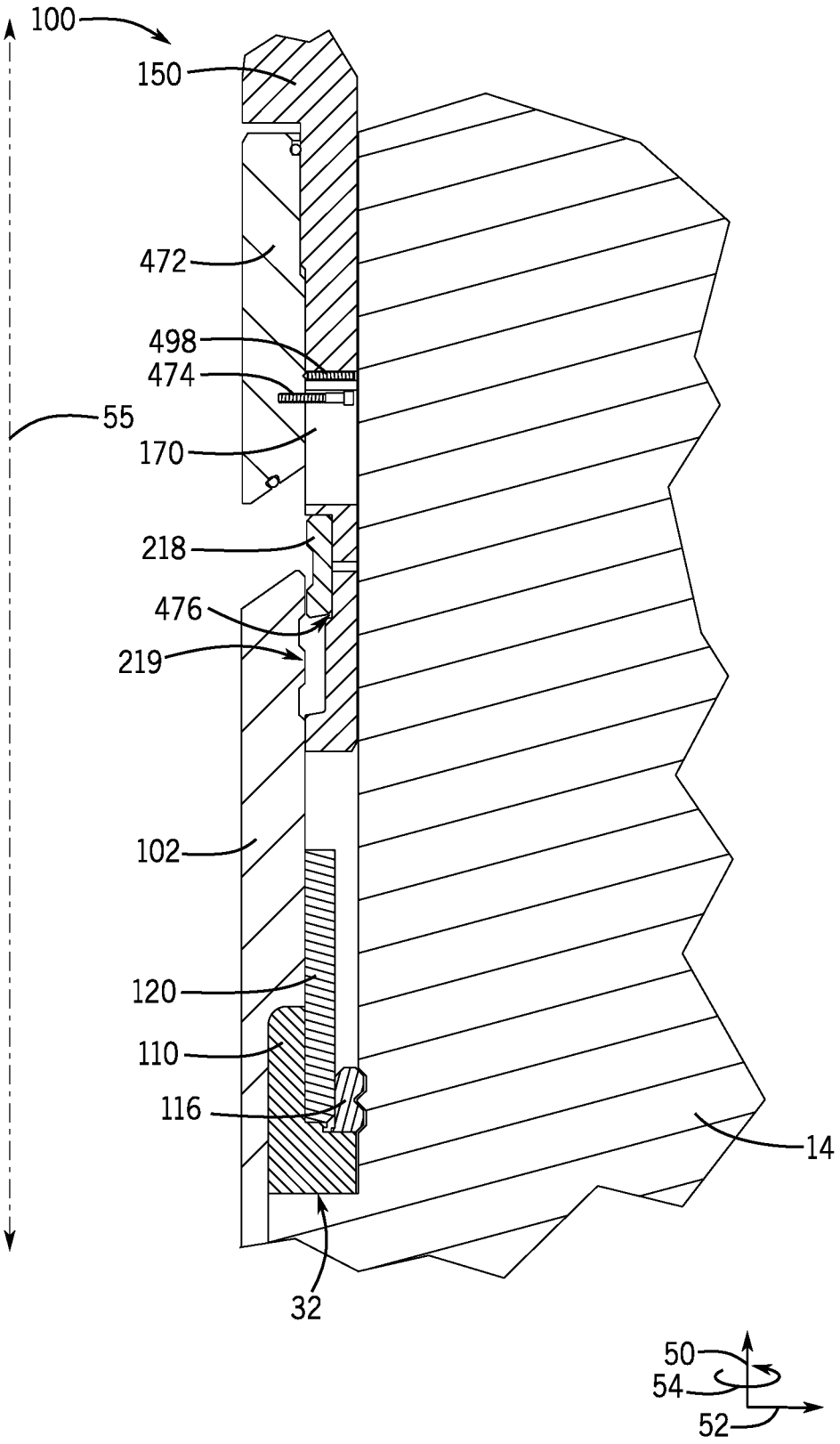
FIG. 14 is a partial, cross-section view of an embodiment of the hanger running tool of FIG. 8 being removed from the wellhead assembly, in accordance with an aspect of the present disclosure.

When the lock ring 218 is disposed in the recess 476, the lock ring 218 is no longer disposed in the groove 219 of the hanger 26, such that the hanger running tool 100 is unlocked (e.g., de-coupled) from the hanger 26. Thus, the hanger running tool 100 may be removed from the wellbore 14, while the hanger 26 remains secured in place in the casing spool 22. For example, FIG. 14 is a partial, cross-section view of the hanger running tool 100 being removed from the wellbore 14, while the hanger 26 is secured to the casing spool 22 via the lock ring 116.

Figure 15:
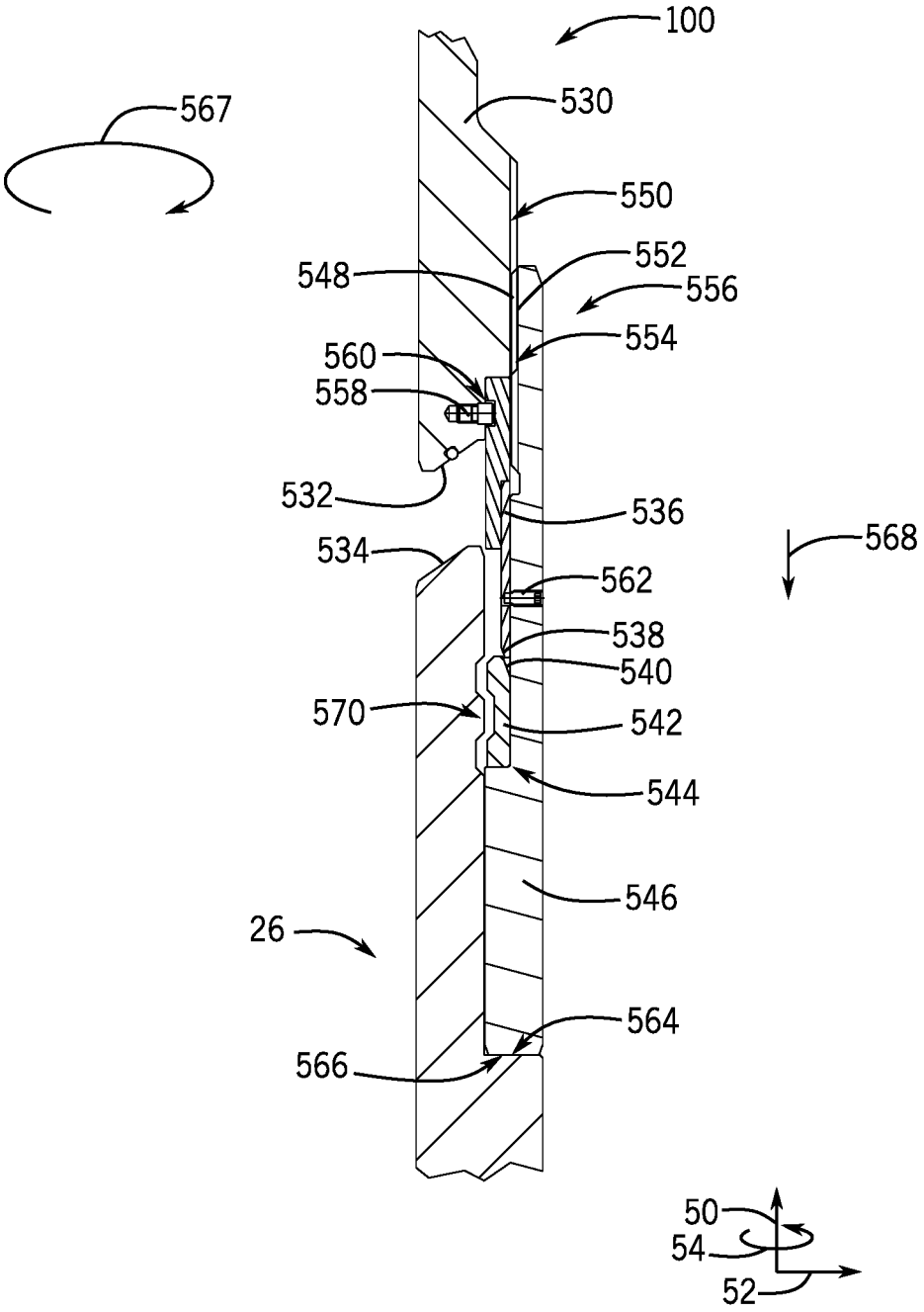
FIG. 15 is a partial, cross-section view of an embodiment of the hanger running tool that may be secured to the hanger using a rotational force and utilized to run the hanger into the wellhead assembly, in accordance with an aspect of the present disclosure.

In some embodiments, it may be desirable to couple the hanger running tool 100 to the hanger 26 via threads to form a secure connection between the hanger running tool 100 and the hanger 26. Such embodiments may not utilize rotation and/or circumferential forces to engage the hanger 26 with the casing spool 22 (e.g., a tubular), but rather to couple the hanger running tool 100 to the hanger 26. For example, FIG. 15 is a partial-cross section view of another embodiment of the hanger running tool 100 that may be utilized to dispose the hanger 26 into the wellbore 14. For example, the hanger running tool 100 may include a body 530 that includes a tapered surface 532 (e.g., an annular tapered surface, a conical surface, or another energizing taper portion) that may be configured to engage with a corresponding tapered surface 534 (e.g., an annular tapered surface, a conical surface, or another energizing taper portion) of the hanger 26 when the body 530 moves in the axial direction 50. Additionally, the body 530 may be coupled to a push member 536 that also includes a tapered surface 538 (e.g., an annular tapered surface, a conical surface, or another energizing taper portion) that is configured to engage with a corresponding tapered surface 540 (e.g., an annular tapered surface, a conical surface, or another energizing taper portion) of a lock ring 542 of the hanger running tool 100 when the body 530 moves in the axial direction 50. In some embodiments, the lock ring 542 may be disposed in a recess 544 of a sleeve 546 of the hanger running tool 100. The sleeve 546 may be coupled to the body 530 via threads 548 on an outer surface 550 of the body 530 and threads 552 on an inner surface 554 of the sleeve 546. Accordingly, at least a portion 556 of the sleeve 546 may axially overlap with the body 530.

Additionally, the push member 536 may be coupled to the body 530 by a fastener 558. The fastener 558 may be disposed in a slot 560 (e.g., an annular slot) of the push member 536. In some embodiments, the fastener 558 may be configured to rotate within the slot 560 of the push member 536, such that the body 530 may rotate independent of the push member 536 (e.g., rotation of the body 530 may not drive rotation of the push member 536). However, as the body 530 moves in the axial direction 50, the fastener 558 may drive movement of the push member 536 in the axial direction because a force is applied to the push member 536 by the fastener 558 (and the body 530). Further, a pin 562 may couple the sleeve 546 to the push member 536, such that rotation of the sleeve 546 may drive rotation of the push member 536. Accordingly, because rotation of the body 530 does not drive rotation of the push member 536, rotation of the body 530 may also not drive rotation of the sleeve 546.

As shown in the illustrated embodiment of FIG. 15, the sleeve 546 may include a surface 564 that is configured to rest on a ledge 566 (e.g., an annular ledge) of the hanger 26. Once the surface 564 lands on the ledge 566, the hanger running tool 100 may rotate in the circumferential direction 54 (e.g., a first circumferential direction 567) to drive the body 530 in the axial direction 50, as shown by arrow 568, and secure (e.g., lock) the hanger running tool 100 to the hanger 26. For example, the body 530 may rotate within the sleeve 546, such that the body 530 rotates in the circumferential direction 54 (e.g., the first circumferential direction 567) and the sleeve 546 remains substantially stationary. In some embodiments, the pin 562 may enable rotation of the body 530 to be independent of rotation of the sleeve 546 (e.g., rotation of the sleeve 546 is not driven by rotation of the body 530). In any case, rotation of the hanger running tool 100 may cause the body 530 to move in the axial direction 50 as the threads 548 move along the threads 552 in the axial direction 50, as shown by the arrow 568.

Figure 16:
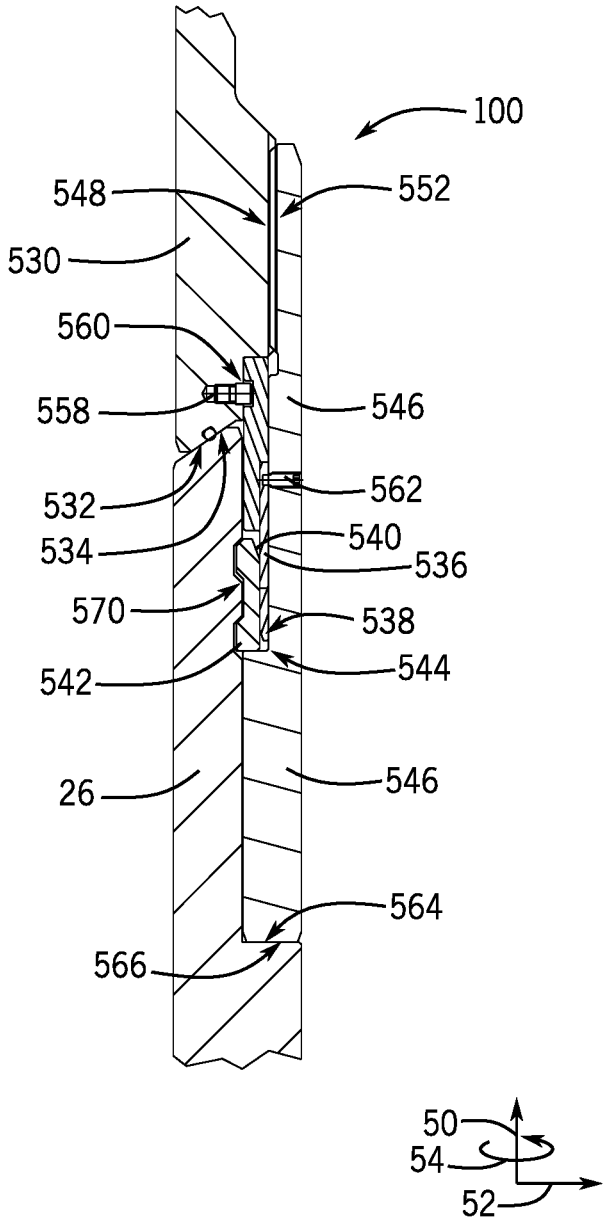
FIG. 16 is a partial, cross-section view of an embodiment of the hanger running tool of FIG. 15 coupled to the hanger, in accordance with an aspect of the present disclosure.

When the body 530 moves in the axial direction 50, as shown by the arrow 568, the tapered surface 538 of the push member 536 may engage with the corresponding tapered surface 540 of the lock ring 542, such that the push member 536 directs the lock ring 542 in the radial direction 52 toward a groove 570 (e.g., an annular groove) of the hanger 26. As the push member 536 moves in the axial direction 50 and directs the lock ring 542 in the radial direction 52, the push member 536 may become disposed between the lock ring 542 and the sleeve 546 (e.g., the recess 544). For example, FIG. 16 is a partial cross-section of the hanger running tool 100 secured to the hanger 26. As shown in the illustrated embodiment of FIG. 16, the lock ring 542 is disposed in the groove 564 of the hanger 26. In some embodiments, the lock ring 542 may include physical features (e.g., protrusions and/or recesses) that may enable the lock ring 542 to secure the hanger running tool 100 to the hanger 26 (e.g., protrusions and or recesses of the lock ring 542 engage corresponding features of the groove 564 which block axial movement of the lock ring 542). Additionally, the lock ring 542 may be biased radially outward toward the sleeve 546. However, because the push member 536 is disposed between the lock ring 542 and the sleeve 546, the lock ring 542 may be blocked from moving in the radial direction 52 by the push member 536.

Figure 17:
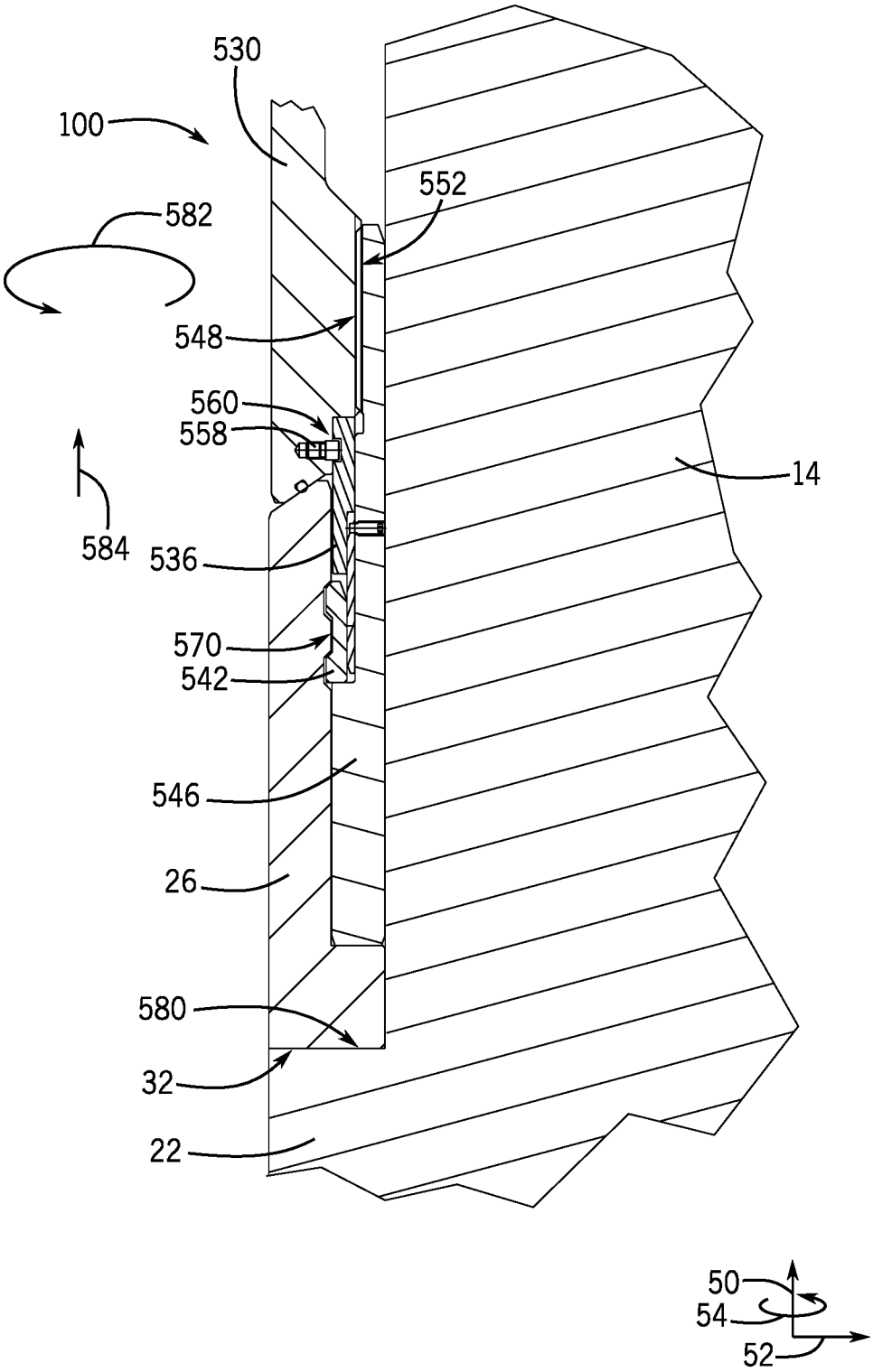
FIG. 17 is a partial, cross-section view of an embodiment of the hanger running tool of FIG. 15 coupled to the hanger and disposed in the wellhead assembly, in accordance with an aspect of the present disclosure.

Once the lock ring 542 is secured in the groove 564 of the hanger 26, the hanger running tool 100 and the hanger 26 may be disposed in the wellbore 14, as shown in FIG. 17. For example, in some embodiments, a surface 580 of the hanger 26 may rest on the shoulder 32 of the casing spool 22. Accordingly, the hanger running tool 100 may be disengaged from (e.g., de-coupled or unlocked from) the hanger 26, such that the hanger 26 may remain in the wellbore 14. To remove the hanger running tool 100, the hanger running tool 100 may be rotated in the circumferential direction 54 (e.g., a second circumferential direction 582), such that the body 530 moves in the axial direction 50, as shown by arrow 584. For example, the threads 548 of the body 530 may move along the threads 552 of the sleeve 546 in the axial direction 50, as shown by the arrow 584. Movement of the body 530 in the upward axial direction (e.g., as shown by arrow 584) may drive the push member 536 in the upward axial direction (e.g., as shown by the arrow 584).

Figure 18:
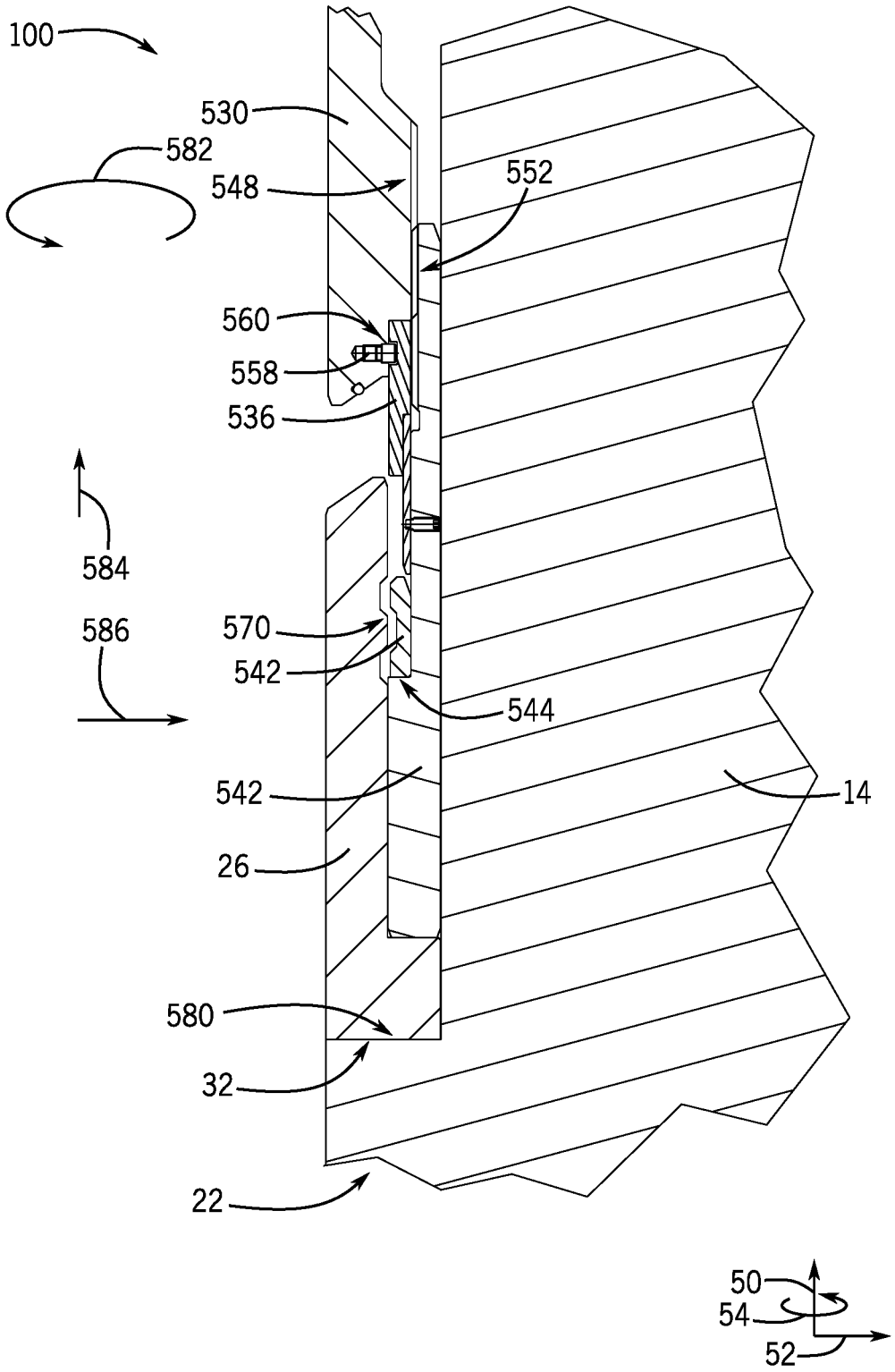
FIG. 18 is a partial, cross-section view of an embodiment of the hanger running tool of FIG. 15 removed from the hanger, in accordance with an aspect of the present disclosure.

For example, FIG. 18 is a partial cross section of the hanger running tool 100 disengaging (e.g., unlocking) from the hanger 26. As shown in the illustrated embodiment of FIG. 18, as the body 530 moves in the upward axial direction (e.g., as shown by arrow 584), the push member 536 moves in the upward axial direction. When the push member 536 moves in the upward axial direction (e.g., as shown by arrow 584), the lock ring 542 may move radially outward toward the sleeve 546 (e.g., because of a bias of the lock ring 542), as shown by arrow 586. Thus, the lock ring 542 may move in the radial direction 52 toward the recess 544, which may unlock the hanger running tool 100 from the hanger 26. Accordingly, the hanger running tool 100 may be directed in the upward axial direction 50 (e.g., as shown by the arrow 584) and out of the wellbore 14.

Figure 19:
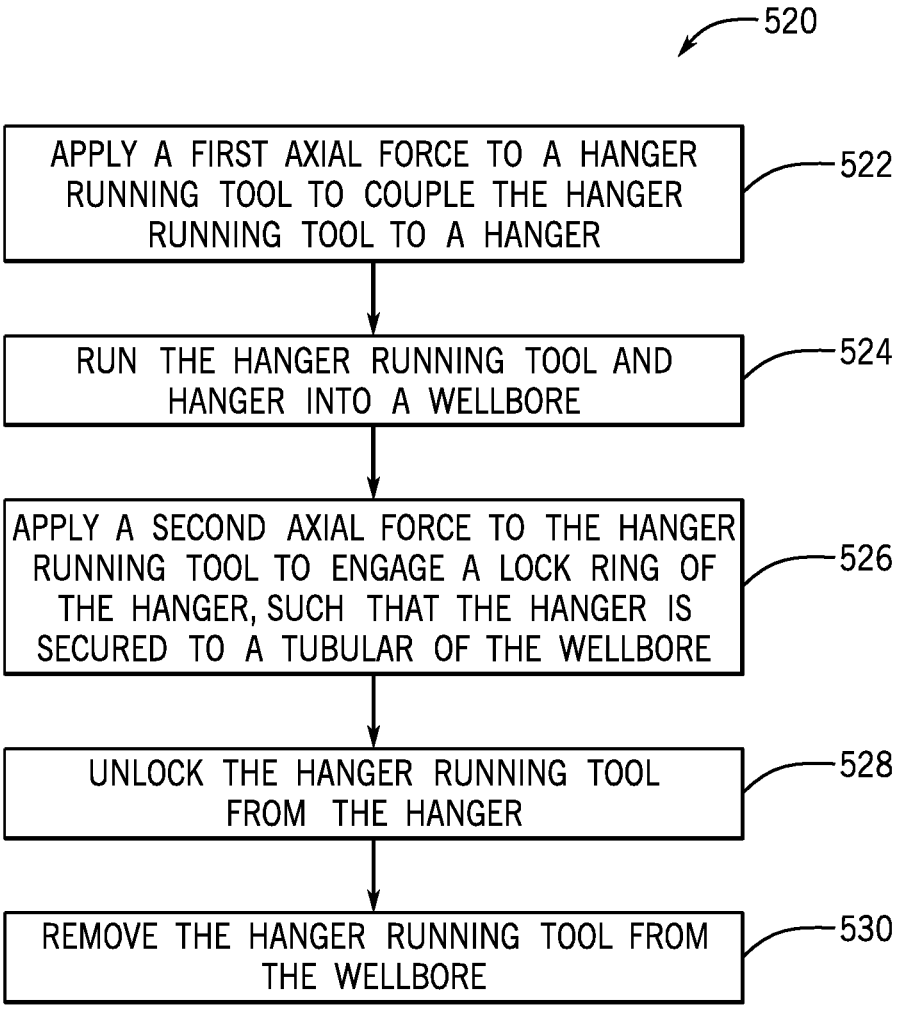
FIG. 19 is a flow chart of an embodiment of a process for coupling the hanger running tool to the hanger, disposing the hanger running tool and hanger into the wellhead assembly, securing the hanger to a tubular of the wellhead assembly, and de-coupling the hanger running tool from the hanger, in accordance with an aspect of the present disclosure.

FIG. 19 is a flow chart of an embodiment of a process 520 that may be utilized to secure the hanger running tool 100 to the hanger 26, secure the hanger 26 to the casing spool 22 of the wellbore 14, and remove the hanger running tool 100 from the wellbore 14. For example, at block 522, a first axial force may be applied to the hanger running tool 100 to couple the hanger running tool 100 to the hanger 26. In some embodiments, the first axial force may be applied via hydraulic pressure (e.g., through the first pressure port 158 and first passage 154) and/or through a physical axial force applied to the hanger running tool 100 (e.g., via a mechanical drive, gravitational drive, hydraulic drive, a pneumatic drive, an electric drive, and/or another suitable device). At block 524, the hanger running tool 100 and the hanger 26 may then be run into the wellbore 14 until the hanger 26 rests on the shoulder 32 of the casing spool 22.

At block 526, a second axial force may be applied to the hanger running tool 100 to engage the lock ring 116 of the hanger 26, such that the lock ring 116 is disposed in the recess 410 of the casing spool 22. Thus, the hanger 26 may be secured to the casing spool 22. Additionally, at block 528, the hanger running tool 100 may be unlocked (e.g., de-coupled) from the hanger 26 (e.g., via another force applied to the hanger running tool 100 and/or automatically through radial force of the lock ring 218). Accordingly, once the hanger running tool 100 is no longer secured to the hanger 26, the hanger running tool 100 may be removed from the wellbore 14, as shown at block 530.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a hanger running tool, comprising:

a tool body having outer threads;

a sleeve having inner threads coupled to the outer threads of the tool body, wherein the sleeve comprises an inner recess;

a radial lock disposed in the inner recess; and a push member configured to drive the radial lock in a radially inward direction to engage a lock recess in a hanger in response to rotation of the tool body in a first rotational direction via engagement of the outer and inner threads, wherein the hanger running tool is configured to run the hanger into a bore of a mineral extraction system while the radial lock is engaged with the lock recess, wherein the hanger running tool is configured to be retrieved without the hanger after releasing the radial lock from the lock recess.

2. The system of claim 1, wherein the tool body is configured to drive the push member in a first axial direction axially against the radial lock and radially between the radial lock and the inner recess to drive the radial lock in the radially inward direction.

3. The system of claim 2, wherein the inner recess comprises an axially facing shoulder, and the radial lock is disposed against the axially facing shoulder.

4. The system of claim 2, wherein the radial lock is biased in a radially outward direction toward the inner recess.

5. The system of claim 4, wherein the radial lock comprises a lock ring.

6. The system of claim 4, wherein the tool body is configured to drive the push member in a second axial direction away from the radial lock to allow the radial lock to move in the radially outward direction to disengage the lock recess in response to rotation of the tool body in a second rotational direction via engagement of the outer and inner threads, wherein the hanger running tool is configured to be retrieved from the bore after the radial lock is disengaged from the lock recess.

7. The system of claim 1, wherein the push member is configured to move axially to drive the radial lock in the radially inward direction to engage the lock recess in the hanger in response to and concurrently with the rotation of the tool body in the first rotational direction via the engagement of the outer and inner threads.

8. The system of claim 1, wherein the tool body is configured to rotate relative to the sleeve and the push member to drive the push member along an axial path of travel.

9. The system of claim 1, wherein the push member is coupled to the tool body via a first connection.

10. The system of claim 9, wherein the first connection blocks axial movement of the push member relative to the tool body, and the first connection enables rotational movement of the push member relative to the tool body.

11. The system of claim 10, wherein the first connection comprises a radial fastener disposed in an annular slot.

12. The system of claim 11, wherein the radial fastener protrudes from an outer surface of the tool body, and the annular slot is disposed along an inner surface of the push member.

13. The system of claim 10, wherein the push member is coupled to the sleeve via a second connection.

14. The system of claim 13, wherein the second connection blocks rotational movement of the push member relative to the sleeve, and the second connection enables axial movement of the push member relative to the sleeve.

15. The system of claim 1, comprising the hanger having an outer recess with a ledge, wherein the sleeve is disposed at least partially in the outer recess against the ledge when the radial lock is engaged with the lock recess.

16. The system of claim 15, wherein the hanger comprises a bottom surface configured to land on a shoulder in a bore of a mineral extraction system.

17. A system, comprising:

a running tool, comprising:

a tool body having outer threads;

a sleeve having inner threads coupled to the outer threads of the tool body, wherein the sleeve comprises an inner recess;

a radial lock disposed in the inner recess; and a push member configured to drive the radial lock in a radially inward direction to engage a lock recess in a component in response to rotation of the tool body in a first rotational direction via engagement of the outer and inner threads, wherein the running tool is configured to run the component into a bore of a mineral extraction system while the radial lock is engaged with the lock recess, wherein the running tool is configured to be retrieved without the component after releasing the radial lock from the lock recess.

18. The system of claim 17, wherein:

the push member is coupled to the tool body via a first connection, the first connection blocks axial movement of the push member relative to the tool body, and the first connection enables rotational movement of the push member relative to the tool body, wherein the push member is configured to move axially to drive the radial lock in the radially inward direction to engage the lock recess in the component in response to and concurrently with the rotation of the tool body in the first rotational direction via the engagement of the outer and inner threads; and the push member is coupled to the sleeve via a second connection, the second connection blocks rotational movement of the push member relative to the sleeve, and the second connection enables axial movement of the push member relative to the sleeve.

19. The system of claim 17, wherein the tool body is configured to drive the push member in a first axial direction axially against the radial lock and radially between the radial lock and the inner recess to drive the radial lock in the radially inward direction, wherein the tool body is configured to drive the push member in a second axial direction away from the radial lock to allow the radial lock to move in a radially outward direction to disengage the lock recess in response to rotation of the tool body in a second rotational direction via engagement of the outer and inner threads, wherein the radial lock is biased in the radially outward direction toward the inner recess, wherein the running tool is configured to be retrieved from the bore after the radial lock is disengaged from the lock recess.

20. A method, comprising:

aligning a hanger running tool with a hanger, wherein the hanger running tool comprises:

a tool body having outer threads;

a sleeve having inner threads coupled to the outer threads of the tool body, wherein the sleeve comprises an inner recess;

a radial lock disposed in the inner recess; and a push member;

moving the push member to drive the radial lock in a radially inward direction to engage a lock recess in the hanger in response to rotation of the tool body in a first rotational direction via engagement of the outer and inner threads; and running, via the hanger running tool, the hanger into a bore of a mineral extraction system while the radial lock is engaged with the lock recess, wherein the hanger running tool is configured to be retrieved without the hanger after releasing the radial lock from the lock recess.

* * * * *